United States Patent [19]

Alink

[11] 4,401,440

[45] Aug. 30, 1983

[54] METHOD AND INSTALLATION FOR PREPARING A COMBUSTIBLE GAS MIXTURE

[75] Inventor: Aloysius J. W. O. Alink, Zevenaar, Netherlands

[73] Assignee: Thomassen Holland B. V., Rheden-de Steeg, Netherlands

[21] Appl. No.: 351,789

[22] Filed: Feb. 24, 1982

[30] Foreign Application Priority Data

Mar. 4, 1981 [NL] Netherlands ..... 8101056

[51] Int. Cl.[3] ..... C10J 3/42; C10J 3/48

[52] U.S. Cl. ..... 48/61; 48/66; 48/68; 48/77; 48/210; 48/211; 422/210; 422/233; 422/239; 431/7; 60/39.35; 60/39.46 S

[58] Field of Search ..... 48/61, 66, 68, 77, 210, 48/211; 422/209, 210, 233, 239; 431/7; 60/39.35, 39.46 S

[56] References Cited

U.S. PATENT DOCUMENTS

| | | | |
|---|---|---|---|
| 2,185,077 | 12/1939 | Galusha | 48/68 X |
| 2,200,066 | 5/1940 | Koller | 48/68 X |
| 4,282,009 | 8/1981 | Belke et al. | 48/61 |
| 4,285,773 | 8/1981 | Taciuk | 422/209 X |
| 4,317,658 | 3/1982 | Hendriks et al. | 48/61 |

OTHER PUBLICATIONS

West Germany–Offenlegungsschrift No. 2852 143 Hitachi Ltd., Tokyo.

*Primary Examiner*—Arthur D. Kellogg
*Attorney, Agent, or Firm*—Laurence R. Brown

[57] ABSTRACT

The invention concerns a method and an installation for preparing a combustible gas mixture from solid or liquid fuels by means of a rotatable cup-shaped, perforated bowl forming a supporting grate with a fuel supply to its inner wall and a feed of gasifying fluid to the outer side of the grate, an intermediate layer of a refractory material being formed against the inner wall of the rotating grate for supporting the fuel and finally dividing the gasifying fluid.

7 Claims, 1 Drawing Figure

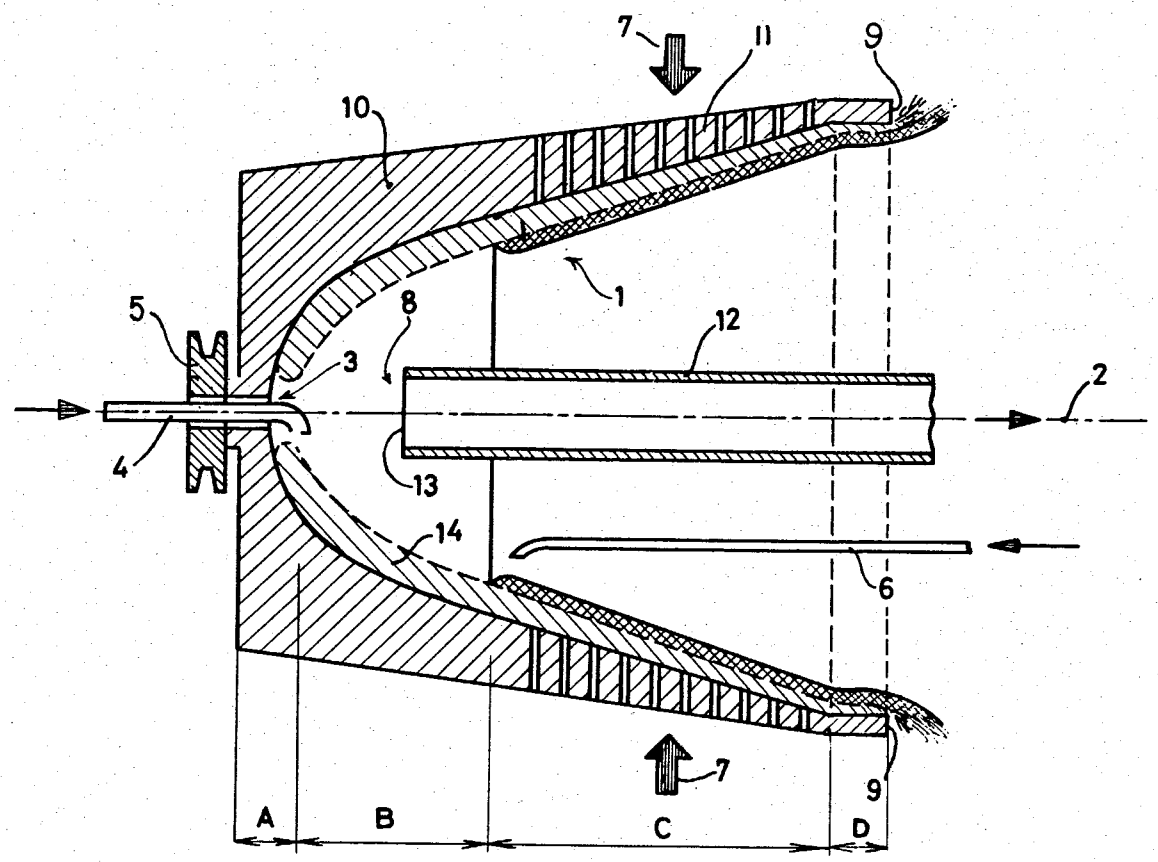
2
9
11
7
1
10
8
3
5
4
12
13
14
6
9
7
A
B
C
D

METHOD AND INSTALLATION FOR PREPARING A COMBUSTIBLE GAS MIXTURE

BACKGROUND OF THE INVENTION

1. Field of the Invention

The present invention relates to a method of preparing a combustible gas mixture from solid or liquid fuels such as e.g. coal, heavy oil or tar sand, while using a processing chamber formed by a rotatable supporting grate having the form of a body of revolution, the fuel being fed to the inner side of said grate, while in addition a gasifying fluid is being supplied on the outer side of the grate and the combustible gas mixture is discharged via an outlet means in the vicinity of the central axis of the grate, a rotational speed being maintained during operation which is such that the fuel is pressed against the supporting grate.

2. Description of the Prior Art

This type of method is described, for instance, in U.S. patent application Ser. No. 175,434 filed on Aug. 8, 1980 now U.S. Pat. No. 4,317,658.

SUMMARY OF THE INVENTION

It is a primary object of the invention to improve said method in several respects with a view to enabling the processing of many types of fuel, and to additionally securing more freedom to determine the residence time of the fuel within the processing chamber.

Said objects are attained according to the invention in that a granular or pulverulent refractory auxiliary material is continuously being admitted to the inner side of the cup-shaped, divergent supporting grate in such a manner, that the entire inner side is covered with a layer which, due to the angle of inclination of the inner side and under the influence of the centrifugal force, gradually moves from the point of admission in the center of the cup to the circumferential edge of the cup, the feeding of the fuel proceeeding upon the traveling layer causing the fuel to move along with the auxiliary material.

The occurring centrifugal acceleration will exert upon the auxiliary material a force such, that the material will move along the inner side of the supporting grate. The component of said force directed tangentially along the inner side of the supporting grate is the greatest along the bottom of the cup, and will diminish in the direction of the circumferential edge. A properly adapted form affords influencing the speed of movement in a manner so that the fuel residence time is obtained as desired, thus bringing about complete gasification and causing exclusively ashes to be discharged (along with the auxiliary material).

The method according to the present invention can be carried out in such a manner that the auxiliary material passing over the edge of the cup-shaped supporting grate is reconditioned and carried back to the point of admission in the center of the cup. It is even conceivable that the granular or pulverulent refractory auxiliary material to be used, is formed by the ashes of the fuel used.

The invention is further embodied in an installation for applying the method as described hereinbefore, comprising a supporting grate having the form of a body of revolution which is rotatable about a central axis and provided with a fuel feed located on the inner side of the grate, a supply means of a gasifying fluid on the outer side of the grate, and a central outlet means for the combustible gas mixture, means in addition being provided for driving the supporting grate, such as those likewise known from the aforesaid earlier Patent Application.

According to the invention, in said installation the inner side of the supporting grate is cup-shaped and roughly corresponds to the form of a paraboloid, means being provided in the proximity of the top of the paraboloid for supplying a granular or pulverulent refractory auxiliary material to the inner side of the grate, said material passing, during operation, along the inner side toward the free edge of the cup as a result of the centrifugal force, the fuel feed means being located at a point downstream of said supply means and upstream of the fluid supply means.

Contrary to the prior art, the inner side of the supporting grate has not the form of a truncated conical surface, but of a cup, in which case the bottom of the cup is covered mainly with a layer of auxiliary material and the fuel is fed at a point where there has already come about a certain degree of stability of the layer.

In an embodiment of the installation according to the present invention, the supporting grate has a pervious or unperforated wall running from the top of the paraboloid to the central area and followed by a perforated wall portion, the feed means of the fuel extending to a point upstream of the latter wall portion. Consequently, the supporting grate is composed of a pervious or unperforated part and a perforated portion. The former portion will have a considerably lower temperature (e.g. 550° C.) than the perforated portion, because in said latter portion the gasification comes about at a high temperature (e.g. 850° C.). In the firstmentioned wall part, a process gas can be supplied through the, eventually, existing perforations, in order to reduce the frictional forces of the auxiliary material which is sliding along the inner wall.

The auxiliary material used has a triple function. In the first place, it forms a certain degree of insulation between the fuel being gasified and the wall of the supporting grate; moreover, the material of the supporting grate is not subjected to the reducing influence of the fuel being gasified. In the second place, the auxiliary material acts as a carrier for the fuel, an increase in the layer thickness having an influence upon the frictional force occurring during the flow of auxiliary material along the inner side of the supporting grate; this affords influencing the residence time of the fuel within the processing chamber. A third function of the auxiliary material consists in properly distributing the gasifying fluid to the fuel supplied. At the considerable centrifugal acceleration occurring, the auxiliary material rests in a very firmly compact condition against the inner side of the supporting grate and there arises a fine porosity through which the gasifying fluid has to penetrate in order to reach the fuel.

The features of the invention, which have been briefly discussed hereinbefore and those yet to be mentioned hereinafter, will be further explained with reference to the drawing which is a longitudinal sectional view of a particular embodiment of a supporting grate that can be used in the method and the installation of the invention.

DESCRIPTION OF THE PREFERRED EMBODIMENTS

In the drawing, the supporting grate 1 has the form of a body of revolution which is rotatable about a central axis 2. The inner side of the supporting grate 1 is cup-shaped and roughly corresponds to the form of a paraboloid. In the vicinity of the top of said paraboloid (or bottom of the cup) the supporting grate has a passage 3 positioned coaxially with the axis 2 of the grate. Fitting through said passage, supply means 4 are provided (e.g. a pipe) enabling a granular or pulverulent refractory auxiliary material to be supplied to the inner side of the cup-shaped supporting grate 1. Said grate is provided with means for producing a rapid rotation about the axis 2, said means having been symbolically denoted in the drawing by a pulley 5. In addition, the installation is provided with fuel feed means 6 directed toward the inner side of the grate 1. The arrows 7 denote a gasifying-fluid suply means (product gas) provided on the outer side of the grate 1. Finally, there is also provided a central outlet means 8 for the combustible gas mixture.

As illustrated, during operation there will arise a carrier layer of the auxiliary material along the inner side of the supporting grate 1 as a result of the occurring centrifugal acceleration. Said layer travels in the direction of the free edge 9 of the cup. The feeding 6 of the fuel proceeds at a point located downstream of the supply means 4 and upstream of the fluid supply means 7. The supporting grate has a pervious or unperforated wall 10 running from the top of the paraboloid to the central area and followed by a perforated wall portion 11. The feed means 6 of the fuel extends to a point upstream of the latter wall portion 11.

The central outlet means 8 for the combustible gas mixture (the process gas) is formed by a pipe 12 which is disposed coaxially with the axis 2 of the supporting grate 1 and the opening 13 of which lies at some distance from the top of the paraboloid. Out of practical and constructional considerations, the inner side of the supporting grate 1 does not constitute a pure paraboloid, but is rather composed of a spherical central part A, a connecting elliptical intermediate portion B, a conical part C, and a cylindrical portion D.

The drawing shows, very schematically, the installation during operation. Through the supply means 4, the granular or pulverulent refractory auxiliary material is continuously being supplied to the inner side of the cup-shaped, divergent supporting grate 1 in such a manner that the entire inner face is covered with a layer 14. Due to the angle of inclination of the inner side of the supporting grate 1 and under the influence of the centrifugal acceleration, the layer 14 gradually moves from the point of admission (passage 3) provided in the center of the cup to the circumferential edge 9 of the cup. The feeding 6 of the fuel proceeds upon said layer 14, so that said fuel moves, along with the auxiliary material, toward the edge 9. The fuel will be gasified completely under the influence of the gasifying fluid (the product gas) fed via the supply means 7, so that the substance passing over the edge 9 will consist of the auxiliary material and the remaining ashes of the fuel. The auxiliary material to be used can be sand that can be reconditioned and carried back to the supply means 4. It is also conceivable that the fuel ashes are used as the auxiliary material. Coal, heavy oil or tar sand can be used as the fuel itself.

The auxiliary material forms a protection for the supporting grate 1 and also acts as a transporting fluid for the fuel to be gasified. The portions A+B of the supporting grate 1 may be made of a simple material, since said portions are not subjected to high thermal stress. The portion C is more heavily stressed, and can be made of a high-grade material and may possibly be exchangeable. The residence time of the auxiliary material and of the fuel within the supporting grate 1 can be influenced during operation by a number of factors, such as the thickness of the layer 14 of the auxiliary material and the speed of rotation of the supporting grate. It is also possible to provide extra resistance in the vicinity of the edge 9 of the supporting grate 1 to so slow down the discharge flow of the layer 14 with the fuel processed. This extra resistance could consist of, for instance, several radially directed pins (not shown) disposed just past the edge 9, said pins being displaceable, so as to form, to a larger or smaller extent, a brake on the mixture flowing out.

What is claimed is:

1. A method of preparing a combustible gas mixture from solid or liquid fuels such as e.g. coal, heavy oil or tar sand, while using a processing chamber formed by a rotatable supporting grate having the form of a body of revolution, the fuel being fed to the inner side of said grate, while in addition a gasifying fluid is being supplied on the outer side of the grate and the combustible gas mixture is discharged via an outlet means in the vicinity of the central axis of the grate, a rotational speed being maintained during operation which is such that the fuel is pressed against the supporting grate, a granular or pulverulent refractory auxiliary material continuously being admitted to the inner side of the cup-shaped, divergent supporting grate in such a manner, that the entire inner side is covered with a layer which, due to the angle of inclination of the inner side and under the influence of the centrifugal force, gradually moves from the point of admission in the center of the cup to the circumferential edge of the cup, the feeding of the fuel proceeding upon the traveling layer causing said fuel to move along with the auxiliary material.

2. The method of claim 1, in which the auxiliary material passing over the edge of the cup-shaped supporting grate is reconditioned and carried back to the point of admission in the center of the cup.

3. An installation for preparing a combustible gas mixture comprising a supporting grate having the form of a body of revolution which is rotatable about a central axis and provided with a fuel feed on the inner side of the grate, a supply means for gasifying fluid on the outer side of the grate and a central outlet means for the combustible gas mixture, means in addition being provided for driving the supporting grate (1), the inner side of which is cup-shaped and roughly corresponds to the form of a paraboloid, means (4) being provided in the proximity of the top of the paraboloid for supplying a granular or pulverulent refractory auxiliary material to the inner side of the grate, said material passing, during operation, along the inner side toward the free edge (9) of the cup as a result of the centrifugal force, the fuel feed means (6) being located at a point downstream of said supply means (4) and upstream of the fluid supply means (7).

4. The installation of claim 3, in which the supporting grate (1) has a previous or unperforated wall (10) running from the top of the paraboloid to the central area and followed by a perforated wall portion (11), the feed means (6) of the fuel extending to a point upstream of the latter wall portion.

5. The installation of claim 3 in which in the vicinity of the top of the paraboloid the supporting grate (1) has a passage (3) disposed coaxially with the axis (2) of the grate, the supply means (4) of the auxiliary material extending through said passage.

6. The installation of claim 3, in which the central outlet means (8) for the combustible gas mixture is formed by a pipe (12) which is disposed coaxially with the axis (2) of the supporting grate (1) and the opening (13) of which lies at some distance from the top of the paraboloid.

7. The installation of claim 3, in which the inner side of the supporting grate (1) is composed of a spherical central part (A), a connecting elliptical intermediate portion (B) a conical part (C) and a cylindrical portion (D).

* * * * *